United States Patent [19]

Cameron

[11] 4,114,128

[45] Sep. 12, 1978

[54] COMPOSITE SECTIONALIZED PROTECTIVE INDICATING-TYPE FUSE

[75] Inventor: Frank L. Cameron, Irwin, Pa.

[73] Assignee: Westinghouse Electric Corp., Pittsburgh, Pa.

[21] Appl. No.: 622,279

[22] Filed: Oct. 10, 1975

Related U.S. Application Data

[63] Continuation of Ser. No. 519,362, Oct. 30, 1974, abandoned, which is a continuation of Ser. No. 67,175, Aug. 26, 1970, abandoned.

[51] Int. Cl.[2] ..... H01H 71/20

[52] U.S. Cl. ..... 337/162; 337/168; 337/219; 337/237

[58] Field of Search ..... 337/161, 162, 144, 219, 337/192, 237, 177–181, 283, 171, 175, 156, 273

[56] References Cited

U.S. PATENT DOCUMENTS

| | | | |
|---|---|---|---|
| 2,441,692 | 5/1948 | Earle | 337/237 X |
| 2,483,577 | 10/1949 | Fahnoe | 337/161 |
| 2,572,901 | 10/1951 | Yonkers | 337/219 X |
| 2,809,254 | 10/1957 | Edsall | 337/162 |
| 3,253,106 | 5/1966 | Holsinger | 337/219 X |

*Primary Examiner*—Robert J. Hickey
*Attorney, Agent, or Firm*—W. R. Crout

[57] ABSTRACT

An indicating composite sectionalized fuse is provided having a high-current interrupting section, and a mechanically-connected detachable low-current interrupting section in series therewith, with the low-current interrupting section including a pull-away indicating fuse-link cable, which indicates externally a blown condition of the fuse. The low-current interrupting section is replaceable, following a low-current interruption, which has no effect upon the high-current interrupting section, the latter remaining intact and may be further used. During high-current interruption, both sections are fused, and collectively contribute together to a quick interruption of the connected electrical circuit, again there being an external indicated condition of the blown condition of the fuse by an ejection of the fuse-link cable.

For certain applications, the high-current interrupting section may comprise a current-limiting fuse, so as to limit the value of "let-through" current during a heavy fault-current condition in the line.

8 Claims, 15 Drawing Figures

INVENTOR
Frank L. Cameron

BY
Willard R. Court
ATTORNEY

BORIC ACID

COMPOSITE SECTIONALIZED PROTECTIVE INDICATING-TYPE FUSE

CROSS-REFERENCES TO RELATED APPLICATIONS

This is a continuation of application Ser. No. 519,362 filed Oct. 30, 1974 by applicant which is, in turn, a continuation of parent application, filed Aug. 26, 1970, Ser. No. 67,175 by applicant both abandoned.

BACKGROUND OF THE INVENTION

Distribution cutouts are widely used for pole-top mounting and protection of distribution circuits. These fuse cutouts must be low in cost, as well as possessing relatively high interruption ratings. As distribution circuits continue to grow in size, the demand is inherent for higher-interruption capacity fuses.

An obvious candidate to fill this need for higher-capacity distribution cutouts is the current-limiting fuse. However, there are numerous design difficulties in translating the idea of a current-limiting fuse into a distribution cutout concept. One of these problems is to provide a pigtail release-type of a connector at one end of the fuse. Mechanical release is effected at the time of "blowing" of the fuse. Another significant problem concerns the interruption of low currents. Although current-limiting fuses are built to successfully interrupt low currents, this low-current interruption is always characterized by a relatively long arcing time, until final clearing is effected. This phenomena conflicts with the necessity of having a drop-out type of action, such as distribution fuse cutouts must possess. The long arcing times indicate a significant time delay between the release of the pigtail (drop-out initiator) and the final clearing of the fault. This results in the fuse drop-out action being effected before the final clearing, and thus, the likelihood of external arcing between the moving fuse ferrule and the external cutout contacts. This is an untenable situation, as such arcing could result in external flashover of the fuse mounting.

A further problem is one of economics. The current-limiting fuse must be basically a more expensive type of device than is the fiber-lined tube of a distribution cutout. Even though the higher capacity inherent in the current-limiting fuse may not always be needed — dependent upon the type of fault and its location — the more expensive fuse would need to be provided to furnish the requisite capacity for a possible fault right at the terminals of the device.

U.S. Pat. No. 3,467,934, issued Sept. 16, 1969, to Robert T. Innis and George E. Mercier, teaches a two-part indicating fuse adaptable for capacitor-unit protection, and including a flexible fuse casing. It is contemplated in this patent that when fuse operation occurs, there will result a breakaway action between the two fuse casing sections of the device to thereby permit a visible indication of fuse operation.

SUMMARY OF THE INVENTION

In accordance with a preferred embodiment of the present invention, there is provided a dual composite sectionalized indicating fusible device comprising a high-current section mechanically connected, and detachable to a separable low-current section. The high-current section is capable of interrupting relatively high currents, and for certain applications, may be of the current-limiting type. The low-current section, on the other hand, is peculiarly adapted for the interruption of relatively low currents (which have no effect on the high-current unit), and results in a breakaway indicating action of the fuse-link cable, which preferably is placed under tensile stress, as by a spring-device unit.

The low-current section preferably includes an expulsion-type of fuse tube, which ejects the fuse-link terminal and the associated flexible fuse-link cable during fuse operation to an external observable indicating position.

It is, accordingly, a general object of the present invention to provide an improved dual sectionalized distribution protective fuse of the observable indicating type.

Another object of the present invention is to provide an improved protective fusible device having high- and low-current sections, separably and detachably mechanically connected together, so that replacement of the low-current section may take place, without affecting the continued further use of the high-current section.

Still another object of the present invention is the provision of an improved composite indicating-type of fusible device, which has, as its high-current interrupting section, a current-limiting type of fuse device, and the separable low-current section, preferably comprising an expulsion-fuse tube with an ejectable fuse-link cable.

Further objects and advantages will readily become apparent upon reading the following specification, taken in conjunction with the drawings.

DESCRIPTION OF THE PREFERRED EMBPODIMENTS

Distribution cutouts are widely used for pole-top mounting and protection of distribution circuits. These fuse cutouts must be low in cost, as well as possessing relatively high interruption ratings. As distribution circuits continue to grow in size, the demand is inherent for higher interruption capacity fuses.

An obvious candidate to fill this need for higher-capacity distribution cutouts is the current-limiting fuse. However, there are numerous design difficulties in translating the idea of a current-limiting fuse into a distribution cutout concept. One of these problems is to provide a pigtail-release type of a connector at one end of the fuse. Mechanical release is effected at the time of "blowing" of the fuse. Another significant problem concerns the interruption of low currents. Although current-limiting fuses are built to successfully interrupt low currents, this low-current interruption is always characterized by a relatively long arcing time, until final clearing is effected. This phenomena conflicts with the necessity of having a drop-out type of action, such as distribution fuse cutouts must possess. The long arcing times indicate a significant time delay between the release of the pigtail (drop-out initiator) and the final clearing of the fault. This results in the fuse drop-out action being effected before the final clearing, and, thus, the likelihood of external arcing between the moving fuse ferrule and the external cut-out contacts. This is an untenable situation, as such arcing could result in external flashover of the fuse-mounting parts.

A further problem is one of economics. The current-limiting fuse must be basically a more expensive type of device than is the fiber-lined tube of a distribution cut-out. Even though the higher-capacity, inherent in the current-limiting fuse, may not always be needed — dependent upon the type of fault and its location — the more expensive fuse would need be provided to furnish the requisite capacity for a possible fault right at the terminals of the device.

My invention satisfactorily answers all of the problems raised hereinbefore. The fusible device of the present invention is of a unique design to assure positive mechanical release each time the fuse blows. The problem of effective and prompt low-current fault clearing is solved by actually building the fuse as a composite device, with minimum arcing, low-current clearing being provided by the fiber-tube expulsion section of the fuse.

Figure 2:
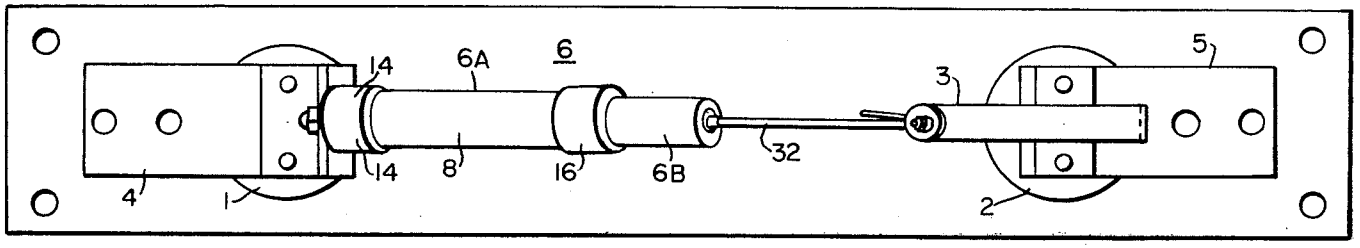
FIG. 2 is a plan view of the fusible device of FIG. 1.
Figure 1:
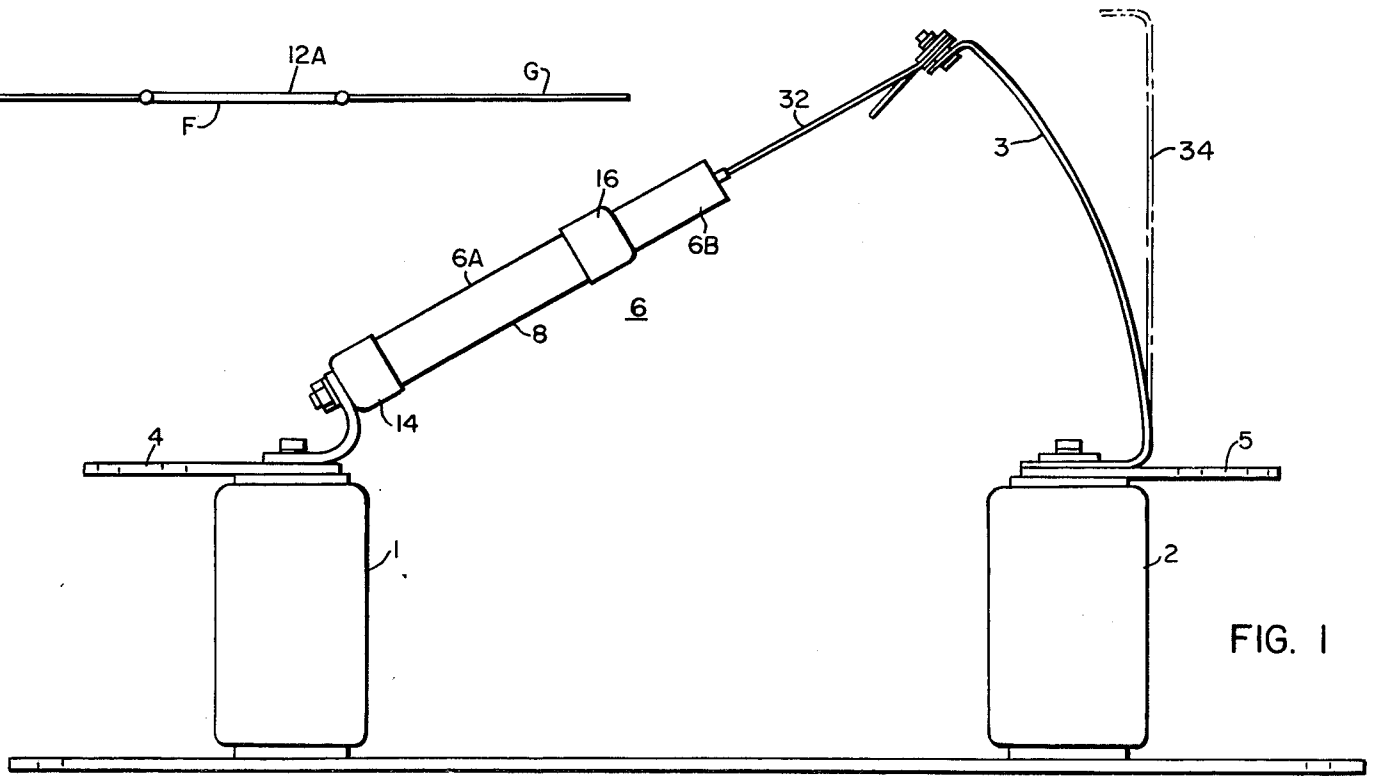
FIG. 1 is a side elevational view of the improved indicating type composite sectionalized fuse of the present invention, the view indicating the fuse in its intact unfused condition.
Figures 3, 4, 4A, 5, 5A, 5B, 6, 8, 9:
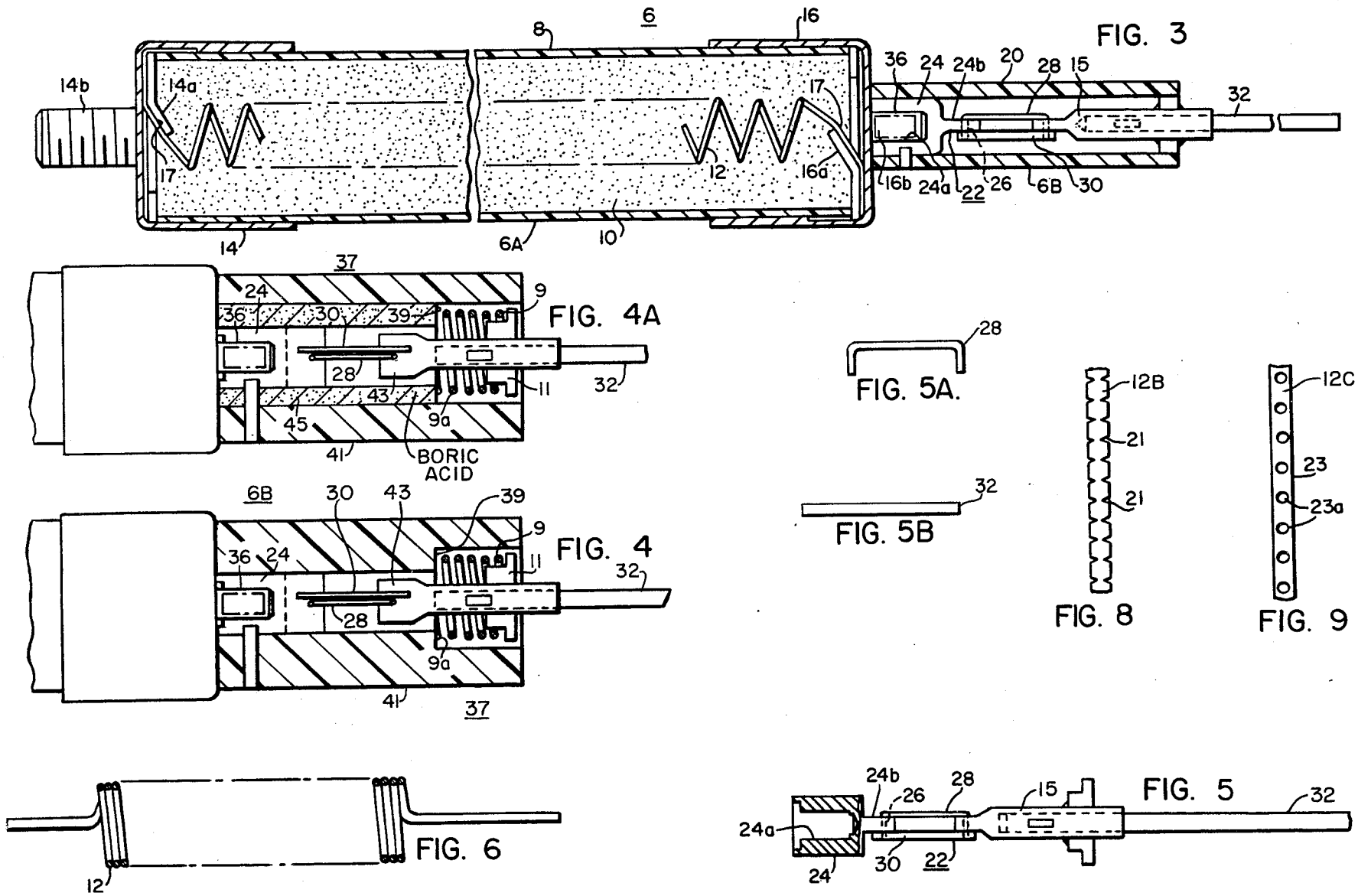
FIG. 3 is an enlarged longitudinal sectional view taken through the composite fusible device of the present invention, indicating the internal fuse elements and component parts of both the high- and low-current interrupting sections, both sections being shown in their intact unfused condition.
FIG. 4 is a fragmentary view of a modification, indicating a different-type of low-current section.
FIG. 4A is a sectional view through a modified-type of low-current fuse section.
FIG. 5 is a side elevational view of the low-current fuse-link assembly with its connecting fuse cable.
FIG. 5A illustrates one of the fuse links of the low-current fuse link assembly of FIG. 5.
FIG. 5B is an end view of the fuse link cable of the low-current fuse link assembly of FIG. 5.
FIG. 6 is a detail view of the fusible wire utilized in the high-current interrupting section, as wound upon a mandrel.
FIG. 8 illustrates another fusible element which may be used in a further modified type of high-current unit.
FIG. 9 illustrates still another fusible element, which may be used in a further modified type of high-current unit.

In more detail, with reference to FIGS. 1 and 2 of the drawings, it will be observed that mounted upon upstanding post-type insulators 1, 2 is a pair of spaced terminals 4, 5, which are bridged by the composite sectionalized fusible device 6 of the present invention. As shown in FIG. 1, the fusible device 6 comprises two sections 6A, 6B, one 6A a high-current section and a mechanically-connected low-current section 6B, the two sections 6A, 6B preferably being screwed, or otherwise detachably secured together, as indicated more clearly in FIG. 3 of the drawings. With reference to FIG. 3, it will be observed that the high-current interrupting unit 6A generally comprises an enclosed cartridge device, or casing 8 at least partially filled with a granular material 10, such as white sand, for example, and enclosing a fusible link 12 of silver, for example, which extends from one end ferrule 14 to the other ferrule 16. As shown, both ferrules 14, 16 have tab portions **14*a*, 16*a*, which are connected, as by brazing 17, to the fusible element 12, which is shown more clearly in FIG. 6 of the drawings. The fusible wire 12, illustrated in FIG. 6, is extended, and is positioned interiorly within the insulating fuse tube, or fuse casing 8, which may be of an insulating material, such as, for example, glass epoxy. The end ferrules 14, 16 may be cemented onto the ends of the outer fuse tube 8, as by cement, staking pins or other suitable attachment means. It will be noted that both ferrules 14, 16 have outwardly extending threaded mounting stud portions 14*b*, 16*b*, the mounting stud portion 16*b*, associated with the right-hand ferrule 16, accommodating the low-current interrupting section, generally designated by the reference number 6B**.

The low-current section 6B, as more clearly illustrated in FIG. 3, comprises an expulsion fiber-lined insulating tube 20, within which is placed the low-current interrupting fusible assembly, designated by the reference numeral 22, and illustrated more clearly in FIG. 5 of the drawings. As shown in FIG. 5, the low-current fusible assembly 22 may comprise a metallic contact terminal 24, which is axially bored, as at **24*a*, and is internally threaded, so as to be capable of threaded detachable attachment to the threaded stud portion 16*b* of the right-hand ferrule 16. The contact 24 has a flattened portion 24*b* with an aperture 26 therethrough, through which extends a U-shaped strain link 28 (FIG. 5A), which may be formed of Nichrome, for example, or other suitable conducting strain-resisting material. Disposed in electrical parallel relation to the Nichrome strain wire 28 is a tin-lead alloy fusible strip 30**, which carries most of the operating current, as well understood by those skilled in the art.

The two fuse links 28, 30 are in electrical parallel, and upon fusion of the lower-melting temperature fuse element 30, the tension element 28 will also fuse, and permit thereby a breakaway action of the fuse-link cable 32, such action being assisted by the biasing action of spring strap 3 (FIG. 1) and the expulsive action of the gases generated within the fiber tube 20 by the heat of the arc. This provides an indicated position of the fusible device 6, as illustrated by the dotted lines 34 of FIG. 1.

The current limiting section, 6A may consist of a silver wire, plain or notched and of one diameter or several diameters as is well known in the art. The element of this section may also rather consist of a perforated or notched silver strap, this latter element more commonly used in the building of higher full-load rated devices. The fuse element may be wound on a core, or as in this simple embodiment, consist of a self-supporting, helically wound section.

The silver fuse element is surrounded by and immersed in fine quartz sand, or other suitable filler. The sand will confine and cool the arc during the interrupting process, and will, in conjunction with the silver element, so limit the fault current and available circuit stored energy as to permit only a minimal discharge from the previously described expulsion section of the fuse.

A notched or stepped fuse element is often used to effect a control of the peak arc voltage which the fuse generates during the interrupting process. A simple, unnotched wire may be effectively used in this instance. The associated expulsion-fuse section of the device so effectively takes care of the low current clearing that a shorter length of element may be provided for the current-limiting section than is customarily used. During the low fault current interrupting process, a current limiting fuse must burn back a length of fuse element such as to insert an adequately high impedance into the arc path. With the associated low-current clearing expulsion section, the length of such burn-back, and consequently the required element length, is reduced. For adequate operation, only a length of fuse element necessary to effect a high-fault current, current limiting action is required. A single diameter, silver fuse wire in sand is an effective high-current limiting device because of several well known phenomena. Due to surface tension, once the length of a liquid cylinder is significantly greater than its diameter, the cylinder becomes unstable and is inclined to break up into drops and unduloids. The creation of these unduloid causes a disruption of the heating with greater current density and the reduced "necks" of the unduloids. Due to a combination of thermal and electromagnetic effects, the element then breaks up into a series of element globules connected by arcs. The summation of all the anode-cathode voltage drops plus the additive lengths of the series arcs greatly determines the arc voltage which the fuse produces, and the effective manner in which it produces current limitation.

It will be obvious to those skilled in the art that the provision of a current-limiting type of high-current unit 6A is very desirable to limit the magnitude of the fault current. However, for particular applications, where a current-limiting function may not be desired, other types of high-current interrupting units 6A may be employed.

The modified low-current unit 37 of FIG. 4 is similar to the unit 6B of FIG. 3 except an ejection compression spring 9 is used to assist in the ejection of the fuse cable during fuse operation. The ejection spring 9 seats on a spring seat 11 affixed to the fuse cable 32. The other end 9a of the ejection compression spring 9 seats on a shoulder portion 39 of the fuse casing 41. As before the strain link 28 and fusible strip 30 are in electrical parallel and function as heretofore described in connection with FIG. 3. Gas generation within the expulsion fiber-lined fuse casing 41 assist the ejection spring 9 in expelling the fuse terminal 43 and fuse cable 32 during blowing of the low-current unit 37.

FIG. 4A is a modification of the expulsion section of this fuse which takes advantage of the more effective interrupting properties of boric acid as contrasted with fiber. Under the action of the electric arc, two molecules of ortho-boric acid $H_3BO_3$ release water vapor as follows: $B_2O_3.3H_2O$. Further water is released as the material is subsequently converted to pyro boric acid and finally boric anhydride $B_2O_3$. The release of this water vapor is extremely effective in cooling the arc and creating a high pressure, turbulent zone which de-ionizes the arc and effectively causes circuit interruption. Item 45 of FIG. **4*a*** shows the addition of a solid cylinder of highly compressed boric acid, which may be cemented or otherwise affixed as a lining to the expulsion fuse tube.

Figure 7:
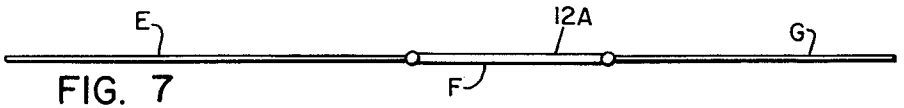
FIG. 7 illustrates one of the fusible elements, which may be used in a modified type of high-current unit.

FIG. 7 illustrates a modified type of stepped fuse element 12A composed of a plurality of stepped wire sections of progressively increasing diameter, E, F and G. FIG. 7 shows the fusible element 12A in a somewhat idealized form, but it will be understood that the fuse element 12A is actually composed of discrete steps E, F and G of wire sizes, which may increase in steps of, for example, 1/1000 of an inch per step. This will provide a desired current-limiting effect for a modified type of high-current current-limiting fuse section 6A.

See Cameron U.S. Pat. No. 3,213,242 for the theory of fuse operation with such a modified type of fuse element.

Other types of fusible elements for the high current interrupting unit 6A to render it capable of exerting. or exercising a current-limiting function, are the fusible elements set forth in FIGS. 8 and 9 of the drawings. As shown in FIG. 8, notches 21 are provided to result in the establishment of a plurality of series arcs during heavy fault-current interruption. FIG. 9 shows a fusible strap with a plurality of spaced perforations **23*a*, which again give rise to a multiplicity of series arcs to perform a current-limiting function during fuse operation of the high-current unit 6A**.

Figure 11:
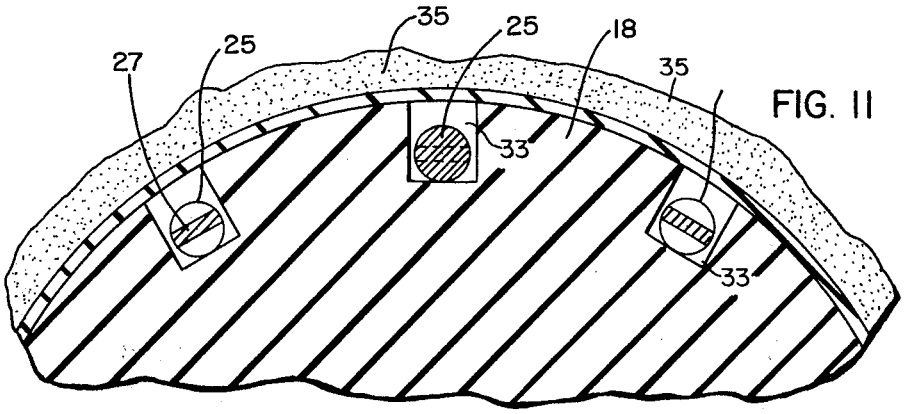
FIG. 11 is a greatly-enlarged sectional portion of the supporting rod of the current-limiting unit of FIG. 10 utilized in the modified-type of current-limiting fuse of FIG. 10, showing the movement possible of the fuse wires within the grooves, and utilizing a thin covering preventing the sand getting into the grooves.

Although FIG. 3 shows only a single wire-type fusible element 12 in the high-current unit 6A, for the higher ratings, two or more of such elements 12 may be provided in electrical parallel, or strap elements 23 may be utilized in parallel with additional tab portions **14*a*, 16*a* being provided, if desired. Reference may be made in this connection to FIGS. 8 and 11 of U.S. Pat. No. 3,374,328, issued Mar. 19, 1968, to Frank L. Cameron, and the disclosure, relating to FIGS. 8 and 11** of said patent, are incorporated herein by reference.

Figure 10:
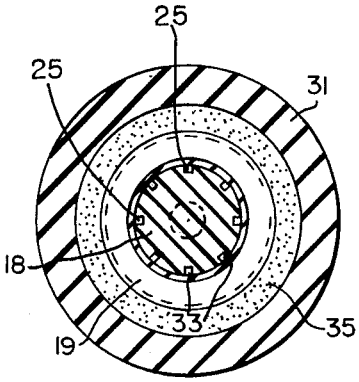
FIG. 10 is a sectional view taken through a modified type of current-limiting fuse.
Figure 12:
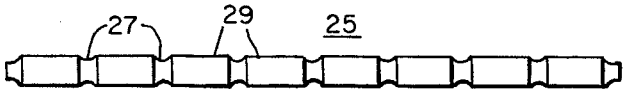
FIG. 12 illustrates, to an enlarged scale, the fusible element, which may be utilized for its current-limiting effect in the structures of FIGS. 10 and 11.

Preferably, the high-current unit 6A is of the current-limiting type, one particular type of which is described in U.S. Pat. No. 2,667,549, issued Jan. 26, 1954, to Harold H. Fahnoe and William A. Gaskill. As set forth in said patent, and with particular reference being had to FIGS. 10, 11 and 12, current limitation is accomplished in this structure by reason of the following factors. The fuse wire 25 is of special construction, and may be of silver, or other material having a high-temperature coefficient of resistance, and is initially chosen to be of substantially the same size of that required to carry the rated current of the fuse without undue heating, and yet melt on currents above the rated current. Such a wire 25 is then provided with a plurality of reduced sections 27 more clearly shown in FIG. 12 of the drawings.

It has been found that in such a wire the fusion time is speeded up to correspond to that of a wire of substantially the same diameter as the reduced sections 27, at least for high values of current. This speeding up effect has been found to be roughly proportional to the ratio between the area of the large portions 29 of the fuse wire 25 and reduced portions 27. As a practical matter, this ratio may be made as high as possible, being limited only by mechanical strength considerations. Such a fuse wire retains all the normal time-current characteristic desired in a fuse for time values in excess of approximately two cycles without appreciable reduction in current-carrying ability. Reduction in current-carrying ability varies roughly directly in proportion to the length of sections 27, so that is desirable that these sections be made as short as possible. For short times of less than one-fourth cycle, fuse wire 25 has an exceptionally fast melting time.

Thus, with a fuse wire 25 having a diameter of 0.036 inch and reduced portions of 0.0145 inch it has been found that the time current characteristic on low currents up to about 400 amperes is substantially the same as those of a fuse wire of uniform diameter equal to the large diameter portion 29 of wire 25. However, on currents above 400 amperes, fuse wire 25 is much faster with its characteristics on these higher currents being substantially coincident with the characteristics of a fuse wire of uniform diameter which is substantially the same as the diameter of reduced sections 27. This means that fuse wire 25 has its continuous current carrying ability substantially unimpaired, by provision of reduced section 27, and even its time current characteristic on light overloads will be substantially unchanged. However, on heavy overloads, where it is desired to limit the current, fuse wire 25 operates much faster than it would without the reduced sections 27, which means that it is possible to initiate the current-limiting action at a very early point in the first half cycle of fault current.

Actual current limitation is effective by providing a high arc voltage upon fusion of fuse wires 25, which arc voltage is built up substantially instantaneously, to thereby exert a limiting of choking effect on the current and prevent its rise beyond a predetermined value. The particular structure disclosed provides a high arc voltage per unit length of unit 31 (FIG. 10), which means that the overall length of the fuse is small. One way of providing such a high arc voltage per unit of arc length is to provide a relatively large number of reduced sections 27 in fuse wire 25 so that when these reduced sections melt, a plurality of serially related arcs will be found and the summation of the arc voltages of these series arcs will then be greater than the arc voltage across a single arc. Generally speaking, the arc voltage per unit of length is directly proportional to the number of series arcs or restrictions 27 per unit of length. This suggests that maximum arc voltage per unit length may be obtained by providing as many restrictions 27 per unit of length as is physically possible. However, as the number of restrictions 27 per unit of length is increased, a point is eventually reached where a further increase results in a decrease in current carrying ability. It has been found that at least for voltages above 600 volts, at least two restrictions 27 per inch of fuse wire 25, or a total of ten should be provided to obtain an effective rise in arc voltage, with a fuse wire which is not of excess length. This corresponds approximately to a spacing of restrictions 27 not to exceed about 15 times the large diameter 29 of the fuse wire 25. It is desirable, however, to use the maximum number of restrictions possible without substantially impairing the current-carrying ability. The most desirable number of restrictions is dependent on the size of the fuse wire 25, and appears to correspond roughly to a spacing of about 3½ times the largest diameter of the wire. This is an optimum spacing, since spacings as low as about twice the largest diameter of the fuse wire may be employed with good results.

Because fuse wires 25 are in close proximity to the walls of slots 33, it will be apparent that the arc formed upon interruption will cause the evolution of arc-extinguishing gas from the walls of the slot 33, and this gas will blast laterally through the arc to perform three functions, all of which act to increase the arc voltage and to extinguish the arc. First, the blast of arc-extinguishing gas acts to sweep metal vapor out of the arc stream and out of slots 33 into the material 35 in which the metal vapor becomes dispersed and condenses into separated particles insulated from each other so that a high resistance path is maintained outside the slots 33. Secondly, the blast of arc-extinguishing gas also acts to supply unionized gas to the arc path to further increase the resistance of the arc path and to extinguish the arc at current zero. A third function of the transverse gas blast is to cause the series arcs to be looped outwardly toward filling material 35, such as sand thereby lengthening the arc path and, consequently, increasing the resistance thereof and the voltage drop across it. One function of washers 19 on supporting rod 18 will now be apparent as preventing escape of the arcs from slot 33 and, consequently, from proximity with the gas-evolving material and from the restricting action from the narrow slot, and thus preventing the series arcs from restriking as a single arc outside the slots 33.

From the foregoing, it is apparent that efficient current limitation of the first half cycle of the arcing current may be obtained with the structures disclosed, because (1) the fusible wires themselves are capable of melting to establish an arc at least on such high currents which it is desired to limit, in a very short time, that is in a very small fraction of a half cycle, (2) as soon as the arc is established it is subjected to all of the factors enumerated above to create an arc voltage high enough to prevent any further rise of a fault current.

My invention satisfactorily answers all the problems raised in the preceding paragraphs, relating to the difficulties of adopting a current-limiting fuse to distribution circuitry with an indicating action. This fuse 6 of my invention is of a design to assure positive mechanical release each time the fuse blows. The problem of effective and prompt low-current fault clearing is solved by actually building the fuse 6 as a composite device with minimum arc-ing, low-current clearing being provided by the fiber-tube expulsion section 20 of the fuse section 6B. This section 6B operates to handle low-current interruptions, and on high-current interruptions is relieved from excessive duty by the current-limiting action of the current-limiting section 6A. The question of economics is resolved by the readily separable composite design. Although the current-limiting section 6A of the fuse 6 must be provided to afford high fault-current protection, the design is such that the current-limiting section 6A will now blow at low values of current, but will in effect be protected by the low-current, fiber-bore section 6B. In the event of a fault current of low magnitude, the fiber-tube section 6B only would blow. This section 6B is low cost and readily removable, and replaceable by threaded attachment, as at 36; thus, for the low-current fault, fuse replacement becomes an economical operation.

My fuse invention can be readily adapted by means of bolt-on connection fittings for mounting in the standard types of distribution cutout mountings. As an alternative, there is shown a design of mounting, which was used for testing of the fuse 6 as herein depicted. This mounting could be used on the distribution circuit as basically designed.

Thus, the fuse 6 has the advantage of drop-out action, low-current clearing with short arcing times, and economical replacement in the form of a high interrupting capacity distribution cutout type fuse.

From the foregoing description, it will be apparent that there has been provided an improved composite indicating-type of fusible device 6, which may be used in distribution circuits, or in other applications, such as for capacitor-unit protection, to provide an economical device in which during low-current interruption, only the low-current unit 6B alone needs to be replaced. In the event of low-current interruption, the high-current unit 6A remains intact and may be used thereafter.

Although there has been illustrated and described particular embodiments of the invention, it is to be clearly understood that the same were illustrated by way of example, and that obvious modifications may be made therein by those skilled in the art, without departing from the spirit and scope of the invention.

I claim as my invention:

1. A composite dual-acting protective fuse comprising, in combination, means defining a high-current current-limiting completely-enclosed interrupting fuse section and a mechanically-connected low-current expulsion-type interrupting fuse section, said low-current expulsion-type interrupting fuse section including a pull-away indicating fuse-link cable which is completely pulled out of said low-current expulsion-type fuse-section following all fuse operations, whereby on low-current interruption, the low-current expulsion-type interrupting fuse section only need be replaced in a refusing operation and both the high-current and low-current fuse sections fusing simultaneously on high-current interruptions.

2. The combination according to claim 1, wherein the low-current interrupting fuse section comprises an expulsion tube having an open end and the fuse link cable is retracted completely out of the open end of the expulsion tube following fuse operation to a visible open-gap disconnecting position.

3. The combination of claim 1, wherein the current-limiting fuse is an enclosed cartridge at least partially filled with sand.

4. The combination according to claim 1, wherein the high-current current-limiting interrupting section has a threaded end stud portion, and the low-current interrupting section may be screwed upon said threaded end stud portion.

5. A composite protective expulsion-type open-ended fuse comprising, in combination:

(a) means defining a high-current, cartridge-type, completely-enclosed, current-limiting-type interrupting section;

(b) means defining a tubular, open-ended, expulsion-type, low-current interrupting section;

(c) means for detachably mechanically interconnecting the high-current interrupting section and the low-current expulsion interrupting section together for separable replacement;

(d) said low-current, expulsion-type, interrupting section including a fuse-link and a connected fuse-link cable with the fuse-link cable extending out the open end of the low-current fuse-tube casing;

e. means for tensioning the fuse-link cable so that both on low-current interruption and on high-current interruption the fuse-link cable will be completely pulled out of the fuse casing by said tensioning means externally to a visual indicating open-gap disconnecting position of the fuse;

f. the characteristics of the current-limiting section being such as not to fuse during low-current interruption; and, g. both interrupting sections substantially simultaneously fusing on high-current conditions so that advantage may be taken of both interrupting capacities on high-current interruption.

6. An indicating-type, composite, fusible device comprising, in combination:

(a) means defining a first high-current-interrupting, current-limiting type, completely-enclosed fusible section;

(b) means defining a second relatively-low-current-interrupting, expulsion-type, fuse-section;

(c) means mechanically connecting said first and second fuse sections together in electrical-series relationship;

(d) said second relatively-low-current-interrupting, expulsion-type, fuse-section including a pull-away indicating fuse-link cable which is completely pulled out of said low-current expulsion-type interrupting fuse section following fuse operation to a visible open-gap disconnecting position;

(e) means biasing said indicating fuse-link cable to an indicating open-circuit position;

(f) only the second relatively-low-current-interrupting, expulsion-type, fuse-section fusing on relatively-low-current interruptions whereby on relatively low-current interruptions the said second low-current-interrupting expulsion-type, fuse-section only need be replaced in a refusing operation; and, (g) the said fusible device so operating and the said first and second fuse-sections so functioning as to simultaneously fuse on high-current interruptions so that two resultant series arcs are thereby established on such high-current interruptions.

7. A composite dual-acting protective fuse-assembly comprising, in combination:

(a) means defining a high-current current-limiting completely-enclosed high-current interrupting fuse-section comprising one or more current-limiting fuse-links;

(b) means defining a low-current expulsion-type interrupting fuse-section having an expulsion-type fuse-link disposed therein;

(c) means connecting a flexible fuse-link cable to said expulsion-type fuse-link;

(d) means biasing said flexible fuse-link cable to a position externally of said low-current expulsion-type interrupting fuse-section;

(e) means removably mechanically interconnecting the high-current current-limiting interrupting fuse-section and the low-current expulsion-type interrupting fuse-section mechanically together for separable replacement, so that the fuse elements of the two fuse-sections are connected electrically in series;

(f) the device functioning upon low-current interruption by the fusion of only the low-current expulsion-type fuse-link, whereas the companion current-limiting fuse-element of the high-current unit remains intact;

(g) the device functioning during high-current fault current interruption so that both fuse-sections simultaneously fuse to interpose thereby two arcs in electrical series into the circuit with the concomitant interrupting action being exerted on both such simultaneously-drawn series arcs;

(h) said biased indicating fuse-link cable being completely pulled out of the low-current expulsion-type interrupting fuse-section following any type of overcurrent fault condition to a completely-visible open-gap disconnecting open-circuit position, thereby indicating to maintenance personnel the "blowing" of said fuse-assembly.

8. The combination according to claim 7, wherein the low-current interrupting fuse-section comprises an expulsion fuse-tube having an open end, and the mechanically biased fuse-link cable is completely retracted out of the open end of the said expulsion fuse-tube following any type of fuse operation of said low-current expulsion-type fuse-section to a visible open-gap disconnecting position, thereby indicating to maintenance personnel at a distance the operation of said protective fuse assembly.

* * * * *